United States Patent [19]

Davis

[11] 4,025,968

[45] May 31, 1977

[54] WATER AND ENERGY SAVING CLOSET TANK FLUSH VALVES

[75] Inventor: Deane N. Davis, Yountville, Calif.

[73] Assignee: The Raymond Lee Organization, Inc., New York, N.Y. ; a part interest

[22] Filed: Apr. 12, 1976

[21] Appl. No.: 676,312

[52] U.S. Cl. ..... 4/67 A; 4/DIG. 1

[51] Int. Cl.[2] ..... E03D 1/34

[58] Field of Search ..... 4/41, 52, 53, 56, 58, 4/60, 65, 67 A, DIG. 1

[56] References Cited

UNITED STATES PATENTS

| | | | |
|---|---|---|---|
| 867,653 | 10/1907 | Gaylord | 4/53 |
| 2,444,959 | 7/1948 | Smith | 4/53 |
| 2,613,367 | 10/1952 | Denham | 4/58 |
| 3,412,161 | 1/1969 | Stafford et al. | 4/67 R |
| 3,894,299 | 7/1975 | Cleary | 4/67 A |
| 3,906,554 | 9/1975 | Johnson | 4/67 R |

*Primary Examiner*—Richard E. Aegerter
*Assistant Examiner*—Stuart S. Levy
*Attorney, Agent, or Firm*—Howard I. Podell

[57] ABSTRACT

A water closet tank flush valve designed to provide a full or partial emptying of the associated water tank, as desired, when the flush valve is operated. A valve stem which is raised to unseat the flush valve is fitted externally along its length with a pair of spaced external recesses. A pair of floats are mounted on individual rotatable levers, one-above-the-other on a slotted tube surrounding the valve stem, so that the upper of the stem recesses is engaged by a detent on the lever of the upper float to retain it in the partly raised position until the water level falls to a first position, after which the first float drops to release the valve stem to seat the tank valve. When the valve stem is raised to the full height, the detent of the lower float lever similarly engages the lower recess of the valve stem as long as the water level supports the lower float. The handle assembly operating the valve stem lever is spring-mounted to the tank wall so as to be limited in rotational range in a first position but to have greater rotational range in a second position of axial movement of the handle shaft for providing for full emptying of the tank contents.

1 Claim, 6 Drawing Figures

WATER AND ENERGY SAVING CLOSET TANK FLUSH VALVES

SUMMARY OF THE INVENTION

My invention is a water closet tank flush valve designed to provide a full or partial emptying of the associated water tank, as desired, when the flush valve is operated. A valve stem which is raised to unseat the flush valve is fitted externally along its length with a pair of spaced external recesses. A pair of floats are mounted on individual rotatable levers, one-above-the-other on a slotted tube surrounding the valve stem, so that the upper of the stem recesses is engaged by a detent on the lever of the upper float to retain it in the partly raised position until the water level falls to a first position, after which the first float drops to release the valve stem to seat the tank valve. When the valve stem is raised to the full height, the detent of the lower float lever similarly engages the lower recess of the valve stem as long as the water level supports the lower float. The handle assembly operating the valve stem lever is spring-mounted to the tank wall so as to be limited in rotational range in a first position but to have greater rotational range in a second position of axial movement of the handle shaft for providing for full emptying of the tank contents.

By means of my invention, the amount of water and consequently energy employed to flush a toilet bowl is minimized by providing alternate levels of operation, as desired, rather than arbitrarily requiring full emptying of the tank with each operation.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
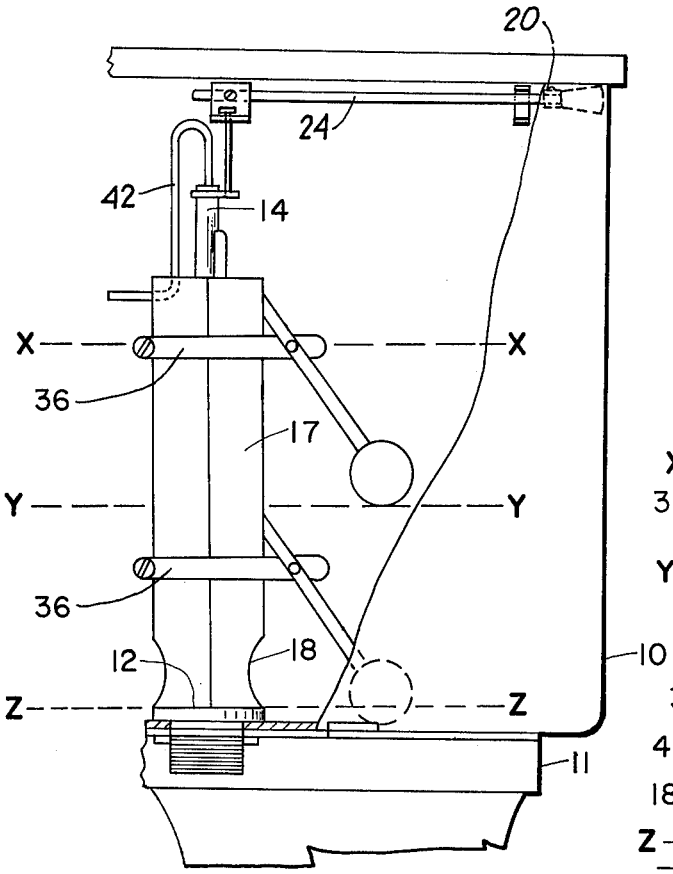
FIG. 1 is a back elevation view of the invention.

Turning now descriptively to the drawings, in which similar reference characters denote similar elements throughout the several views, FIGS. 1–4 illustrate the invention mounted in the tank 10 of a toilet unit 11 employed to store water at an initial level X—X and to flush the stored water into an attached toilet bowl (not shown) through a drain outlet 12 controlled by a weighted hollow ball valve 13 until the water falls to a second level Y—Y or a third level Z—Z, as desired by operation of handle assembly 20.

The following description will employ directional terms based on the erect position of the tank 10 and associated mechanism based on the normal position of operation.

Ball valve 13 is fixed to the bottom of hollow vertical valve stem 14 which is slidably mounted in guide collar 15 fixed by a brace 16 to the internal wall of a fixed vertical tube 17 surrounding the ball valve 13, valve stem 14 and drain outlet 12. Tube 17 is fitted at its lower end with openings 18 to permit water in the tank 10 to drain through outlet 12 when ball 13 is lifted off drain 12.

Figure 2:
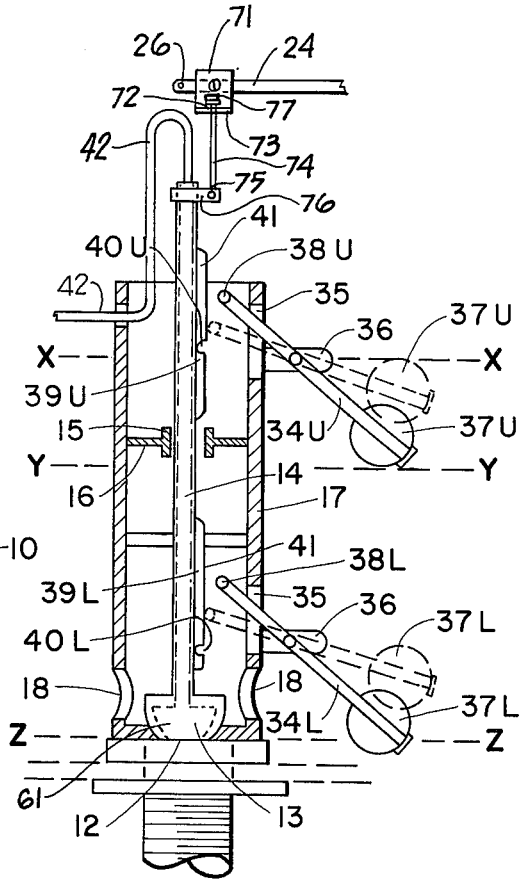
FIG. 2 is a back sectional view of the invention.

With ball valve 13 in the seated position shown in FIG. 2, water flows into tank 10 through an inlet pipe (not shown), with a conventional float and float operated valve (not shown) shutting off flow of water through the inlet pipe whenever the tank water level reaches a pre-set height X—X.

Shaped tube 42 is also connected to the inlet pipe to cause water to flow through the interior of hollow valve stem 14 and ball valve 13 through bottom opening 61 of ball valve 13 into the drain outlet 12 so as to refill the trap of the attached toilet bowl after flushing, and after ball valve 13 has reseated while tank 10 is being refilled. After reseating of ball valve 13, hollow valve stem 14 also serves as an overlfow tube for tank 10.

Valve stem 14 is raised, for flushing of tank 10 by rotation of handle 21 externally mounted on shaft 22 through a hole 23 in the wall 19 of the tank. Shaft 22 is fixed to lever 24 which is joined to valve stem 14 so as to lift stem 14 when lever 24 is rotated from the rest position shown in solid lines in FIGS. 3A, 3B and FIG. 4, to either a first position 24A engaging a bracket 25 as shown in dash lines in FIG. 3A, for partial flush or to a second position 24B free of bracket 25 as shown in dash lines on FIG. 3B, for a full flush.

U-shaped bracket 25 is mounted internally to the toilet bowl wall 19 with a long leg 27 extending under lever 24 to support lever 24 in the rest position with a shorter leg 28 extending above lever 24. Shaft 22 is biased axially by a compression spring 29 to normally maintain handle 21 away from the wall 19 as shown in dash lines in FIG. 3, and maintain lever 24 between bracket arms 27 and 28 so as to limit the rotational travel of handle 21 and lever 24 to the position 24A. Pushing against handle 21, prior to manually rotating the handle, serves to move lever 24 clear of bracket leg 28 so that lever 24 may be rotated freely to the full throw of handle 21 to the position 24B shown in dash lines in FIG. 3B, for a full flush of tank 10.

Figure 4:
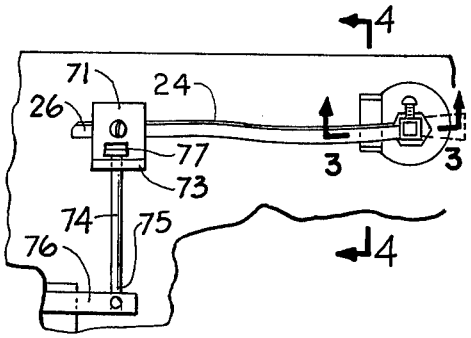
FIG. 4 is a rear elevation view of the handle assembly.

Lever 24 is fitted to vertical valve stem 14 as shown in FIG. 4, so as to latch lever 24 and valve stem 14 in the upward movement of the end 26 of lever 24 with lever end 26 free to drop, while valve stem 14 remains in the raised position.

An angle member 71 is bolted to lever rod end 26, with a hole 72 in angle flange 73 enclosing loosely a threaded rod 74 which is fixed at its lower end 75 to clamp 76 fastened to valve stem 14. A pair of nuts 77 mounted on the upper end 78 of rod 74 serve as adjustable stops to engage angle flange 73 when lever 24 is rotated upwards to lift rod 74 and attached valve stem 14.

An upper and a lower float lever 34U and 34L respectively are each pivotably mounted by a clamp 36 about vertical tube 17 one above the other with the external end of each lever fitted with a float ball 37U and 37L respectively, and with the internal end of each lever fitted with a roller detent 38U and 38L respectively, with levers 34U and 34L each passing through a slot 35 in tube 17.

A pair of slide arms 39U and 39L are mounted externally one-above-the-other to the valve stem 14.

The slide rods 39U and 39L are each formed with an external shaped recess 40U and 40L respectively.

The floats, slide arms and recesses are located with respect to each other so that in the full condition of tank 10 with the water at level X—X, both roller detents 38U and 38L rest against the external wall 41 of a slide arm 39U and 39L respectively.

Figure 3:
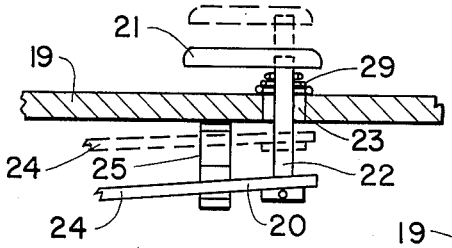
FIG. 3 is a fragmentary sectional view, taken along line 3—3 of FIG. 4.
Figure 3A:
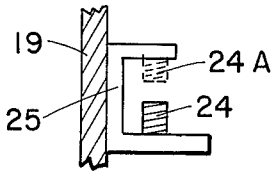
FIG. 3A is a fragmentary sectional view, taken along line 4—4 of FIG. 4 with the handle spring-biased so as to provide a partial flush of the tank.
Figure 3B:
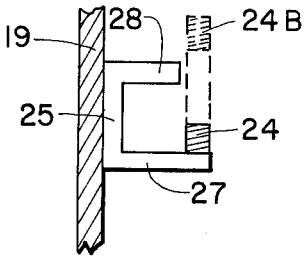
FIG. 3B is a fragmentary sectional view, taken along line 4—4 of FIG. 4, with the handle pushed to provide full range of operation.

Recess 40U on upper slide arm 39U is of a shape to engage roller 38U and is located so as to engage roller 38U of the upper float lever 34U when valve stem 14 is lifted to an intermediate position by lifting of lever arm 24 to a first position 24A by manual rotation of handle 21, as shown in FIG. 3A. Lever 34U is of a length to free roller 38U from engagement with recess 40U when float 37U falls from an initial position, shown in dash lines in FIG. 2, in which it is floating in the water to a second position shown in solid lines, where float 37U is not supported by the water in tank 10 which has fallen to intermediate water level Y—Y.

Engagement of roller 38U in recess 40U serves to prevent valve stem 14 and valve ball 13 from dropping, once valve stem 14 has been lifted and valve ball 13 had been unseated. Rotation of float lever 34U to the second position and freeing of roller 38U from engagement in recess 40U permits valve stem 14 to drop and to seat valve ball 13 against drain outlet 12.

Recess 40U is shaped to permit roller 38U to roll out of recess 40U with futher upward travel of stem 14, when handle 21 is pushed against spring 29 so as to permit full travel of lever 24 to a second position and upward travel of stem 14 to the full upward position for a full flush of tank 10.

Recess 40L is located on lower slide arm 39L, below upper slide arm 39, so as to engage roller 38L when stem 14 has been lifted to the position of full upward of the travel, during which recess 40U of upper slide arm has passed roller 38U and become disengaged from roller 38U.

The geometry and structure of lever 34L and cooperation and engagement of associated roller 38L with recess 40L is similar to that described above for lever 34U with roller 38L disengaging from recess 40L to permit valve ball 13 to seat after the water in tank 10 has fallen to lower level Z—Z.

It is to be noted that in the full upward travel position of stem 14, upper lever arm 34U rotates to the release position freeing roller 38U from contact with upper slide arm 39U prior to release of lower roller 38L from lower recess 40L, as the water level drops past intermediate level Y—Y.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A toilet tank flush valve system which permits emptying of the tank from the normal storage level to either one of two pre-set water levels comprising a drain valve structure installed in a toilet tank in the form of a non-flotable hollow valve member fixed to a hollow support stem slidably mounted to a fixed support structure, said valve member adaptable to seating upon and closing a drain outlet at the bottom of an installed toilet tank, said fixed support structure being in the form of a hollow vertical tube concentrically mounted about the said support stem and valve member, with said tube fixed about the drain outlet of the toilet tank, said tube extending upwards above said drain outlet, said tube formed with a through opening at its lower end to permit water to flow from said tank into the drain outlet when the valve member is unseated from the drain outlet, with a first float mounted to a first float lever pivotally fixed to said support structure and a second float mounted to a second float lever pivotally fixed to said support structure, with each float lever extending through an opening in the tube of the support structure, and with the float of each float lever fixed to the first end section of its respective float lever that extends externally beyond the said tube, with each of the two float levers fitted at its second end section, that extends inside the said tube, with individual means to engage the support stem when the individual float of the float lever is in a first position in which it is buoyed by water in the tank at or above the level of the respective float, said means being free of engagement with the support stem when the respective float has rotated to a second position of lesser buoyancy than the first position in response to a lowering of the level of water in the tank, said means of engagement serving to limit downward movement of the said support stem, while permitting upward movement of the support stem in the installed position, in the first position of each float, said float levers located on the support structure such that each float is responsive to a different level of water in the tank in individually rotating from the first position to the second position, with the support stem linked to an operating lever fixed to a handle structure mounted to the wall of a toilet tank, said handle structure fitted with means to vertically lift the support stem alternately to either a first position of limited travel or a second position of full travel, said support stem engaging the first float lever when initially moved to said first position limited travel and engaging the second float lever when moved to said second position of full travel, when the tank contains water at the normal storage water level of the tank, together with a refill supply tube extending freely into the top opening of the hollow support stem and located so as to not interfere with vertical movement of said stem, such that water flowing out of said refill tube into the interior of the hollow support stem will flow through the hollow valve member into the drain outlet, when said valve member is seated or unseated upon the drain outlet.

* * * * *